United States Patent [19]

Ahrens

[11] 4,341,377

[45] Jul. 27, 1982

[54] SEESAW

[75] Inventor: Paul W. Ahrens, Grinnell, Iowa

[73] Assignee: Miracle Recreation Equipment Company, Grinnell, Iowa

[21] Appl. No.: 183,050

[22] Filed: Sep. 2, 1980

[51] Int. Cl.[3] ..... A63G 17/00

[52] U.S. Cl. ..... 272/54; 272/52; 272/55

[58] Field of Search ..... 272/55, 54, 56, 50, 272/110, 52, 52.5, 53.1, 53.2; 248/609; 403/225; D21/66, 71, 247, 251, 242, 243

[56] References Cited

U.S. PATENT DOCUMENTS 3,675,919 7/1972 Ewers ..... 272/54

3,836,140 9/1974 Ahrens ..... 272/54

4,226,411 10/1980 Manus ..... 272/55

*Primary Examiner*—Richard J. Apley

*Assistant Examiner*—Arnold W. Kramer

*Attorney, Agent, or Firm*—Zarley, McKee, Thomte, Voorhees & Sease

[57] ABSTRACT

A seesaw comprising or two pairs of oppositely extending arms having seats at their outer ends are connected to the sides of a frame enclosure which embraces a support post having sides and is connected thereto for resilient up and down pivotal movement through three spaced rubber blocks per arm which have their opposite ends mounted on pins carried on the opposing sides of the enclosure and the post, two being in a common horizontal plane below the third centrally disposed above and therebetween.

4 Claims, 5 Drawing Figures

SEESAW

BACKGROUND OF THE INVENTION

A conventional seesaw or teeter-totter is not spring loaded and thus affords no protection to the users whereby up and down oscillations are not dampened and result in sudden starts and stops which may very easily cause damage to the equipment and injury to the users. Further, only a two-position seesaw is possible since movement occurs in only one vertical plane.

It is thus seen that a seesaw is needed that will provide resilient controlled up and down movement for two or more users which do not have to necessarily be of the same weight. The playground seesaw of this invention meets these and other objectives.

SUMMARY OF THE INVENTION

A square post is anchored to the ground and a substantially square enclosure is placed over the post and connected thereto through three cylindrical substantially solid rubber spring-like blocks which are mounted on pins carried on oppositely disposed faces of the enclosure and post. The enclosure may include two or four oppositely disposed arms carrying seats at their outer ends all of which form a substantially integral seesaw which is free to move in a number of different vertical planes in response to the various loads that may be placed on the outer ends of the arms. Pivotal up and down movement does not occur just in one or two vertical planes as the up and down movement is infinite but controlled and dampened by the springs which prevent extreme oscillations which can cause damage or injury.

The enclosure is easily assembled and connected to the center post through the rubber blocks by building the enclosure around the post and on the rubber blocks and then interconnecting the diagonally extending overlapping opposite ends of each side.

DESCRIPTION OF THE PREFERRED EMBODIMENT

Figure 1:
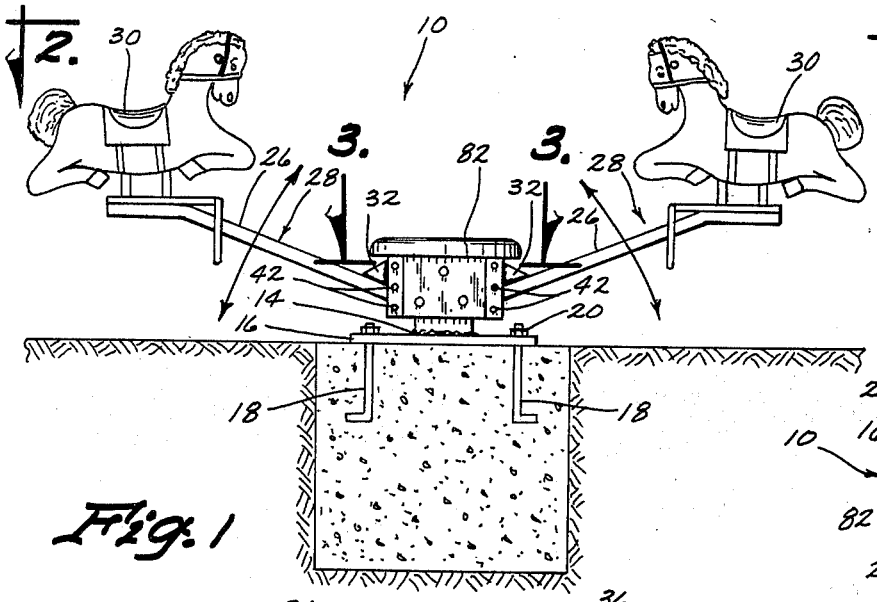
FIG. 1 is a side elevational view of the seesaw of this invention.

The seesaw of this invention is referred to generally in FIG. 1 by the reference numeral 10 and includes a square post welded at 14 to a base plate 16 anchored to the ground by bolts 18 having nuts 20. The post 12 is formed by two L-shaped plates 22 welded together at corners 24.

Figure 2:
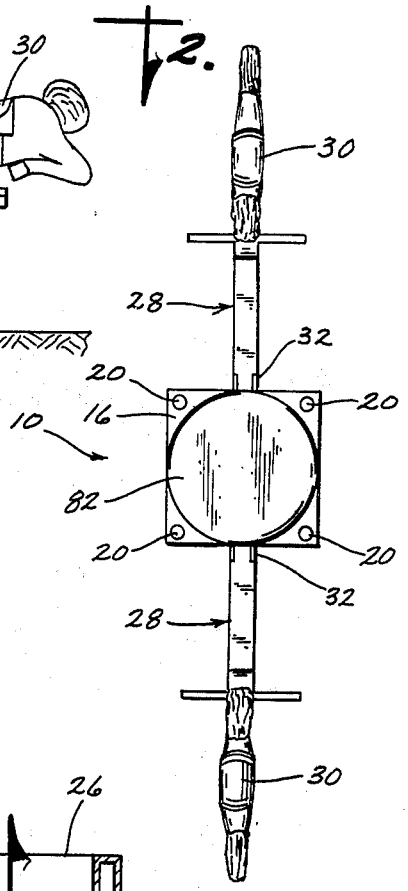
FIG. 2 is a top plan view thereof.
Figure 3:
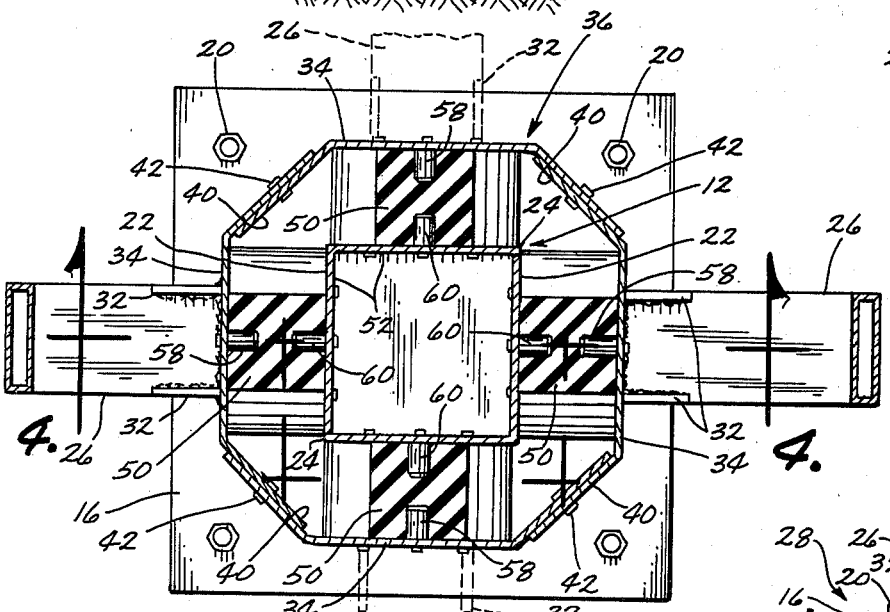
FIG. 3 is a cross-sectional view taken along line 3—3 in FIG. 1.
Figure 5:
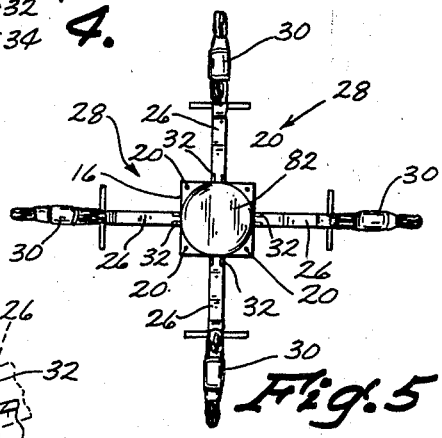
FIG. 5 is a top plan view similar to FIG. 2 but showing a second pair of arms and seats extending at 90° to the first pair of arms.

As seen in FIG. 2, a pair of oppositely extending arms 26 are included in each arm assembly 28 which also includes a horse-riding seat 30 at the outer free end. The inner end 32 of the arm 26 includes an enclosure plate 34 which forms one side of a square box-like frame enclosure 36. Each plate 34 includes opposite end portions 40 in overlapping relation to the end portions 40 of the adjacent plate 34 and are locked together by bolts 42. The end portions extend diagonally, as seen in FIG. 3. It is thus seen that the four plates 34 form a continuous solid enclosure 36 to which one or two pairs of arm units 28 are integrally connected, as indicated in FIGS. 2 and 5, with the second pair of arms 26 being indicated by dashlines in FIG. 3.

The resiliency for the seesaw action is provided by three circular three and a half inches in diameter and three and a half inches long solid rubberblock-like elements 50 positioned between adjacent sides 52 of the post 12 and plates 34 of the enclosure 36. The sides 52 and the plates 34 each carry oppositely disposed pins 60 and 58, respectively, which are received in the opposite ends of the cylindrical blocks 50. Two of the three rubber blocks 50 are in a common lower horizontal plane with the third being in an upper plane centered between the two lower rubber blocks.

A cap 82 is provided over the top of the post 12 and the enclosure 36.

Figure 4:
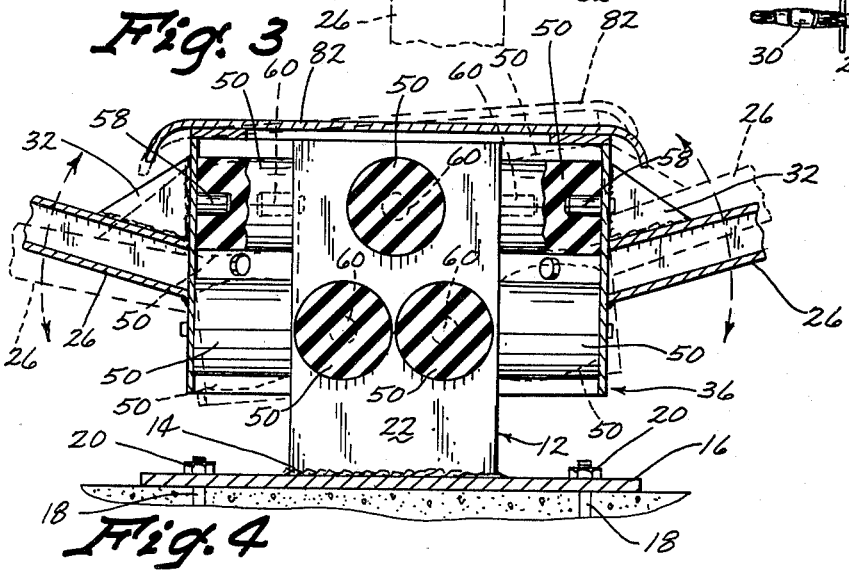
FIG. 4 is a cross-sectional view taken along line 4—4 in FIG. 3.

Thus it is seen that safe, uniform, controlled seesaw movements may be produced in an infinite number of vertical planes as different riders impart different actions to the seesaw 10, as indicated in FIG. 4 by the dashline representations of the arms. As indicated with a conventional seesaw or teeter-totter the up and down movement is only in a single vertical plane and only two riders can use the equipment at one time as pivotal movement is about a single horizontal axis. It is further apparent that the seesaw may be quickly and easily assembled and is totally safe during operation, and will provide unlimited enjoyment for persons using it.

I claim:

1. A seesaw comprising at least a pair of oppositely extending arms having seats at the outer ends thereof, said arms being connected to the sides of a frame enclosure which embraces a support post having sides and which is connected thereto for resilient up and down pivotal movement by three spaced rubber blocks per arm which have their opposite ends mounted on pins carried on the opposing sides of the enclosure and post, said rubber blocks being cylindrical and having oppositely disposed axial openings at opposite ends in which said pins are received, there being three rubber blocks per arm, two being in a common horizontal plane below the third centrally disposed above and therebetween.

2. The structure of claim 1 wherein a second pair of oppositely extending arms are interconnected at their inner ends by said frame enclosure and include seats at their outer ends, said arms of said second pair of arms are in a vertical plane extending perpendicular to the vertical plane of said first pair of arms and said frame enclosure and post include opposing sides for each arm.

3. The structure of claim 2 wherein said arms and frame enclosure form a substantially integral rigid unit thereby providing uniform up and down movement of oppositely disposed arms.

4. The structure of claim 1 wherein said frame enclosure includes a plurality of side members having opposite ends interconnected to adjacent opposite ends of the adjacent side members and said plurality of said members forming a continuous multi-sided enclosure.

* * * * *